United States Patent [19]

Mendler

[11] Patent Number: 4,494,486

[45] Date of Patent: Jan. 22, 1985

[54] SANDWICH NIPPLE PLATE FOR A STEAM GENERATOR DRYER

[75] Inventor: Oliver J. Mendler, Munhall, Pa.

[73] Assignee: Westinghouse Electric Corp., Pittsburgh, Pa.

[21] Appl. No.: 535,506

[22] Filed: Sep. 26, 1983

[51] Int. Cl.[3] ..... F16T 1/00; F22B 37/26

[52] U.S. Cl. ..... 122/491; 122/488; 122/489; 122/492; 122/360

[58] Field of Search ..... 122/488, 489, 491, 492, 122/512, 360

[56] References Cited

U.S. PATENT DOCUMENTS

| | | | |
|---|---|---|---|
| 911,397 | 2/1909 | Howell | 122/512 X |
| 1,205,037 | 11/1916 | Shepard | 122/512 X |
| 2,058,240 | 10/1936 | Hobbs | 122/491 |
| 2,378,862 | 6/1945 | Place | 122/491 |
| 2,594,490 | 4/1952 | Patterson | 122/491 X |

*Primary Examiner*—Edward G. Favors

*Attorney, Agent, or Firm*—F. J. Baehr, Jr.

[57] ABSTRACT

A moisture separator is provided which incorporates two perforated plates assembled in association with a plurality of nipples. The nipples extend through a plurality of holes in a first of the two perforated plates. Each nipple is provided with one end which has an upset portion to prevent its complete passage through the holes of the first perforated plate. A second perforated plate is assembled with the first perforated plate in such a way so as to prevent the reverse passage of the nipples in a direction opposite that of assembly. The first and second perforated plates can be rigidly fastened together by bolting, riveting or welding. In a moisture separator made in accordance with the present invention, the individual nipples do not require welding, rolling or hydraulic expansion during the assembly process and do not have to be rigidly attached to either of the two perforated plates. The cooperation of the two plates holds the nipples in position.

5 Claims, 5 Drawing Figures

SANDWICH NIPPLE PLATE FOR A STEAM GENERATOR DRYER

BACKGROUND AND SUMMARY OF THE INVENTION

The present invention relates generally to steam generators and, more particularly, to the manufacture of steam generators in which a sandwich nipple plate is incorporated to provide a uniform flow of steam to a moisture separating apparatus.

In applications where it is desirable to reduce moisture content of steam, one method for performing this function is to direct a flow of steam between a plurality of chevron plates which are arranged in such a way that the moisture-laden steam is impacted against a plurality of discontinuities in the chevron plates. As the steam impacts these discontinuities, some of its entrained moisture is deposited on the chevron plates and thus removed from the steam. This deposited moisture is then conducted away from the steam path towards a drain system.

In order to improve the moisture separating efficiency of this type of moisture separator, it has been found that the provision of a perforated plate upstream from the chevron plates is advantageous. The function of the perforated plate is to distribute the steam in a uniform flow pattern prior to its passage between the chevron plates. A typical application of a moisture separator of this type is a steam generator of a nuclear power plant system.

These perforated plates also beneficially cause a portion of the moisture to be separated from the steam as the moisture laden steam impacts the portions of the plate which are not perforated. However, this additional beneficial moisture removing characteristic of the perforated plates can be diminished if the separated moisture is subsequently drawn through the perforations as it runs down along the impaction surface of the perforated plate. In order to take full advantage of the moisture separating characteristics of the perforated plate, it has been found that the addition of tubes, or nipples, can prevent the separated moisture from being drawn through the perforations by the normal flow of steam passing through a plurality of holes in the perforated plate.

These tubes, or nipples, are disposed in a way so that they extend through holes in the perforated plate in a direction away from the chevron plates and toward the incoming flow of steam. Therefore, as the moisture which has been separated from the steam by the perforated plate passes in a downward direction along the impaction surface of the perforated plate, the nipples prevent the steam from carrying this moisture through the perforated plate in a direction toward the chevron plates.

The tubes, or nipples, can be attached to the perforated plates in a number of ways. For example, the fastening of the nipples to the plate can be accomplished by welding, rolling or hydraulic expansion. However, a plurality of perforated plates is used in a steam generator and each of these perforated plates would require multiplicity of nipples attached to it. Since a typical steam generator would typically necessitate the use of over 13,000 nipples, a four-loop nuclear plant would require over 24,000 nipples even if only the lower dryer here was designed in this way.

Obviously, if conventional manufacturing methods were used to attach the nipples to the perforated plates, their manufacture would become so costly that serious consideration of their use would be essentially eliminated. In order for perforated plates of a steam generator to be equipped with nipples so that moisture which is collected on the plate can be prevented from being swept into the chevron plate of the dryer, some practical means for manufacturing the improved nippled plates is necessary.

The present invention provides a means for manufacturing nippled plates for steam generators which does not necessitate the welding, rolling or hydraulic expanding of each of the nipples. In a steam generator made in accordance with the present invention, two perforated plates are used in conjunction with a plurality of tubes which each have one of their ends upset. A first of the two plates is provided with a plurality of holes which are shaped to receive the tubes in sliding relation therein. The holes of this first plate are shaped so that the tubes can easily be inserted into them. These holes of the first plate are also sized in such a way that the upset portion of each of the tubes cannot pass through them.

After inserting a plurality of the tubes through the holes of the first plate, a second plate is disposed against the first plate in such a way that it prevents the passage of the tubes out of the first plate in a reverse direction from the initial assembly procedure described above. After assembly, the first and second plates are associated proximate each other with their planar surfaces parallel. The plurality of tubes are disposed in such a way that they extend through the first plate and away from both plates. Following an assembly procedure of the type described above, the two plates are fastened together by either welding or bolting.

The present invention does not require the welding, rolling or hydraulic expanding of the individual tubes and therefore significantly reduces the labor intensive operations required to manufacture a nippled perforated plate and the overall cost thereof.

BRIEF DESCRIPTION OF THE DRAWING

The present invention can better be understood by a reading of the description of the preferred embodiment in conjunction with the Figures, in which.

DESCRIPTION OF THE PREFERRED EMBODIMENT

The present invention relates generally to moisture separators and, more specifically, to moisture separators which incorporate sandwich-nippled plates for use in moisture separators.

Figure 1:
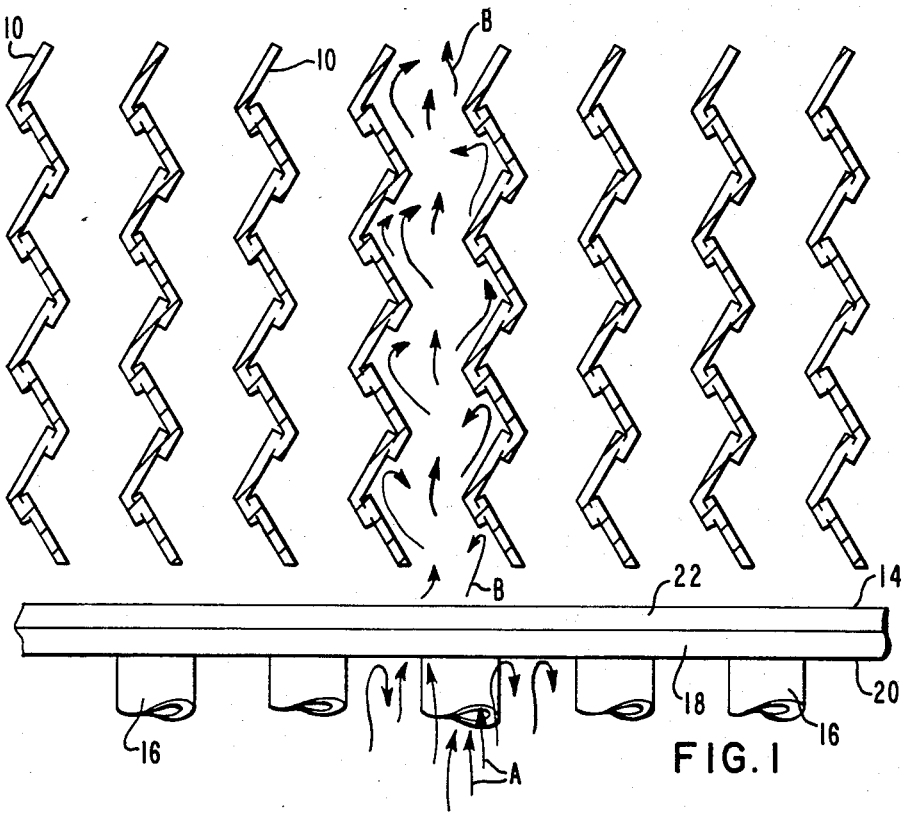
FIG. 1 illustrates the relative position of chevron plates and perforated plates of a moisture separator.

In moisture separators, such as those used within steam generators of nuclear power plants, a plurality of chevron plates are utilized in order to remove entrained moisture from steam. In FIG. 1, a plurality of chevron plates 10 are arranged in such a way so as to provide a plurality of steam passageways 12 between them. It should be understood that FIG. 1 is a sectional view of an association to chevron plates. When these chevron plates 10 are used in conjunction with a nippled perforated plate 14, the moisture-laden steam, indicated by arrows A, enters the region of the moisture separator and a portion of this steam passes through the nipples 16, which are short segments of tubing. The steam that passes through the nipples 16 proceeds into the passageways 12 between the chevron plates 10. The steam which does not pass directly through the nipples 16 impinges against a surface 20 of a first perforated plate 18 and, because of this impingement, a portion of the moisture which is entrained in the steam is deposited on the outer surface 20 of the first perforated plate 18. This moisture then passes downward, due to the effects of gravity, into a drainage system (not illustrated in FIG. 1). Eventually, all of the steam which enters the region of the moisture separator passes through the nipples 16 and into the passageways 12 between the chevron plates 10.

As the steam passes through the passageways 12 between the chevron plates 10, it encounters a plurality of discontinuities on the surfaces of these chevrons 10 and these discontinuities cause a multiplicity of individual impingements of moisture-laden steam against the surfaces of the chevron plates 10. These impingements, in a way which is similar to the separation of moisture against the first plate 18, cause moisture to be removed from the steam as it passes through the passageway 12. This passage of steam between the chevron plates 10 is illustrated by arrows B. For simplicity, only one passageway is shown having steam traveling through it, but it should be understood that each of the plurality passageways 12 operates in a similar manner.

A moisture separator made in accordance with the present invention would incorporate a sandwich nippled plate 14 which comprises both a first perforated plate 18 and a second perforated plate 22. These two plates, 18 and 22, operate in cooperation with a plurality of nipples 16 to form a sandwich-nippled plate which reduces the cost of manufacture.

Figure 2:
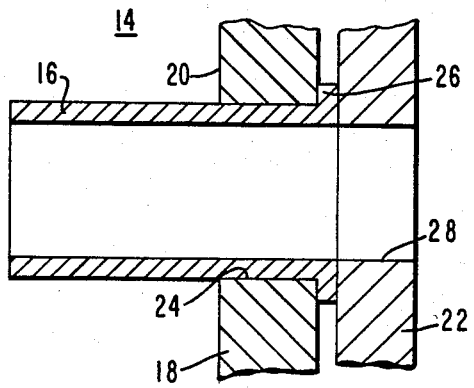
FIG. 2 illustrates a section view of a perforated plate made in accordance with the present invention.

FIG. 2 illustrates a cross sectional view of the sandwich nipple plate 14 which is illustrated in FIG. 1. In FIG. 2, the first perforated plate 18 is provided with a hole 24 which is shaped to receive a tube 16, or nipple, in sliding relation therethrough. The nipple 16 is provided with an upset 26 at one of its ends.

The upset 26 of the nipple 16 is shaped so that it can prevent the complete passage of the nipple 16 through the hole 24 of the first plate 18. As can be seen in FIG. 2, the nipple 16 is disposed through the hole 24 of the first plate 18 in such a way that it extends through the hole 24 away in a direction from the outer surface 20. A second perforated plate 22 is disposed proximate the first perforated plate 18 in such a way that the planar surfaces of these two plates are generally parallel. The second perforated plate 22 is provided with a hole 28 which is generally aligned with the central bore of the nipple 16 so that the central bore of the nipple 16 and the hole 28 of the second plate 22 are in fluid communication with each other. Furthermore, the second perforated plate 22 cooperates with the upset 26 of the nipple 16 in such a way so as to prevent the reverse passage of the nipple 16 in a direction out of the hole 24.

The first 18 and second 22 perforated plates can then be attached to each other by either bolting, riveting, butt welding or spot welding. It should be apparent that, if the first and second perforated plates are rigidly attached to each other in any way, the nipple 16 is held in its position as shown in FIG. 2.

Figure 3:
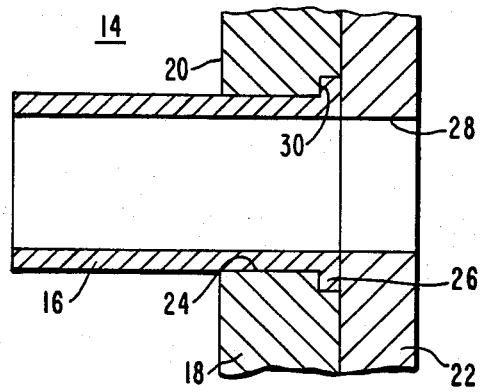
FIG. 3 illustrates an alternative embodiment of the present invention.

FIG. 3 illustrates an alternative embodiment of the present invention. As discussed above in conjunction with FIG. 2, the apparatus illustrated in FIG. 3 comprises a nipple 16 which has an upset 26 at one of its ends. This nipple 16 is disposed through a hole 24 in a first perforated plate 18. A second perforated plate 22 is disposed proximate the first perforated plate 18 with a hole 28 aligned generally with the bore of the nipple 16. The difference between the illustrations of FIGS. 2 and 3 is that, in FIG. 3, the first perforated plate 18 is provided with a counterbore 30 which is shaped to receive the upset 26. The advantage of the embodiment illustrated in FIG. 3 is that the upset 26 of the nipple 16 is recessed below the surface of the first perforated plate 18 in such a way that the second perforated plate 22 can be disposed in direct contact with the first plate 18. The advantage of the configuration illustrated in FIG. 3 is that the first 18 and second 22 perforated plates can be more easily spot-welded together following the assembly of the nipple 16.

Figure 4:
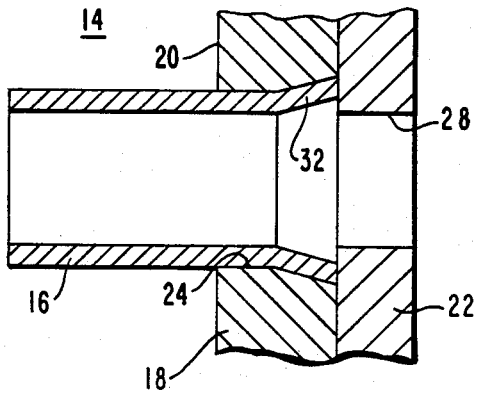
FIG. 4 illustrates another alternative embodiment of the present invention.

Another alternative embodiment of the present invention is illustrated in FIG. 4. As in FIGS. 1, 2 and 3, it incorporates a first perforated plate 18 associated with a second perforated plate 22 in such a way that their planar surfaces are generally parallel. Furthermore, it utilizes a nipple 16 extending through a hole 24 in the first perforated plate 18 and a hole 28 in the second perforated plate 22 which is generally aligned with the central bore of nipple 16. The difference between the embodiment illustrated in FIG. 4 and the previous two embodiments described above is that the upset 32 of the nipple 16 has a different shape. Also, the hole 24 in the first perforated plate 18 is provided with a portion which is shaped to receive this upset 32.

Similarly to the embodiments illustrated in FIGS. 2 and 3, the alternative embodiment which is illustrated in FIG. 4 incorporates a fastening of the first 18 and second 22 perforated plates together. The fastening of these two plates can be accomplished by bolting, riveting, spot welding or butt welding.

Referring to the alternative embodiments illustrated in FIGS. 2, 3 and 4, certain similarities and differences can be observed. In each of the embodiments, a nipple 16 extends through a hole 24 in a first perforated plate 18 in such a way that the nipple 16 extends away from an outer surface 20 of the first perforated plate 18. Also, a second perforated plate 22 is associated with the first perforated plate 18 in such a way that a hole 28 in the first perforated plate 22 is aligned generally with the central bore of the nipple 16. In all of the embodiments of the present invention illustrated in these Figures, the first perforated plate 18 is attached to the second perforated plate 22 by some suitable way such as bolting, riveting or welding.

One of the distinctions apparent between the preferred embodiments illustrated in FIGS. 2 and 3 is that, in FIG. 3, the first perforated plate 18 is provided with a counterbored portion 30 which is shaped to receive the upset 26 of the nipple 16. This characteristic, as compared to the embodiment illustrated in FIG. 2, allows the first 18 and second 22 perforated plates to be disposed in intimate contact with each other in such a way that spot welding of the two plates is facilitated. The embodiments illustrated in FIGS. 3 and 4 are different in their specific shapes of their upset portions. The upset 26 illustrated in FIG. 3 extends in a direction which is generally perpendicular to the central axis of the nipple 16 whereas the upset portion 32 of the nipple 16 illustrated in FIG. 4 extends at an angle which is less than 90° from the central axis of the nipple 16. However, both embodiments which are illustrated in FIGS. 3 and 4 provide for intimate contact between the first 18 and second 22 perforated plates in such a way that spot welding of these plates is facilitated.

In all of the embodiments discussed above and illustrated in FIGS. 2, 3 and 4, the second perforated plate 22 prevents the movement of the nipple 16 in a direction which would be opposite to that of its initial assembly through the hole 24 in the first perforated plate 18. Furthermore, in all of the embodiments discussed above, the nipple 16 extends in a direction away from both perforated plates.

Figure 5:
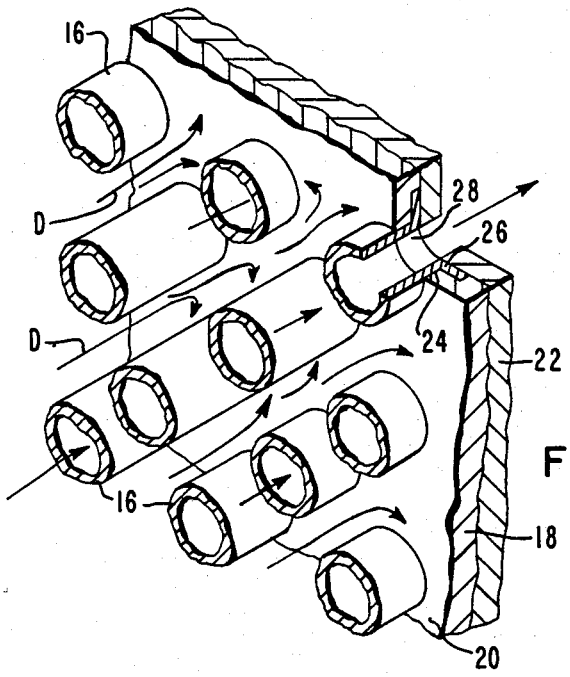
FIG. 5 illustrates an assembly of perforated plates with a plurality of nipples made in accordance with the present invention.

FIG. 5 illustrates an assembly of a first perforated plate 18, a second perforated plate 22 and a plurality of nipples 16 extending outward from the first perforated plate 18. It should be understood that although only a small number of nipples 16 are illustrated in FIG. 5, in actual practice many thousands of nipples 16 would be utilized in a typical sandwiched nipple plate for a steam generator dryer. In FIG. 5, one of the plurality of nipples 16 is shown in a section view in order to more clearly show the relationship between the up-set 26 of the nipple and the plates. The hole 28 in the second perforated plate 22 is generally aligned with the central bore of the nipples 16 so that a fluid passing through the nipple 16 would also pass through the hole 28. Also illustrated in FIG. 5 is the flow of steam as indicated by the arrows T and D. Arrows T indicate the path of steam which passes through the bores of the nipples 16 and subsequently through the second perforated plate 22. Arrows D indiate the steam which does not immediately pass through the central bore of the nipples 16, but instead, impacts against the outer surface 20 of the first perforated plate 18. It is this impaction, indicated by arrows D, which causes a portion of the entrained moisture to be removed from the steam and flow as a liquid, indicated by reference letter L, downward along the surface 20 of the first perforated plate 18.

FIG. 5 also illustrates, the primary function of the nipples 16. As the liquid L flows downward along the surface 20, the nipples 16 reduce the tendency of this liquid L to be drawn through the holes of the perforated plates and thus improves the efficiency of the moisture-removing tendency of the perforated plates.

It should be apparent that, although the nipples 16 which are illustrated in FIG. 5 are of the specific embodiment of the present invention which is illustrated in FIG. 3, the alternate embodiments of the present invention which are illustrated in FIGS. 2 and 4, could have been chosen for this illustration. It should also be apparent that, in order for a nippled plate to function properly, the nipples 16 must extend from the surface 20 of the first perforated plate 18 in a direction from which the steam is flowing. Furthermore, although the specific length of this extension is not critical, the nipples 16 must extend from the surface 20 an amount which is sufficient to prevent the liquid L from being drawn into the mouth of the nipples 16.

It should be apparent that the present invention provides a nippled plate to be used in conjunction with a moisture separator of a steam generator. Furthermore, it simplifies the manufacture of a nippled plate and significantly reduces its cost. Although the present invention has been described herein with considerable detail, it should be understood that the scope of the present invention should not be considered to be so limited.

What I claim is:

1. A moisture separator comprising a plurality of chevron-shaped plates forming a sinuous flow path for moisture laden fluid flowing therebetween;

a first plate disposed generally normal to said chevron plates;

said first plate having a plurality of holes disposed therein;

tubular nipples disposed in said holes;

said tubular nipples having one end upset and the other end extending away from the surface of said first plate;

a second plate having apertures which register with openings in said tubular nipples, said second plate being proximate said first plate and fastened thereto in such a manner that the upset ends of said tubular nipples are clamped between said first and second plates and said tubular nipples extend toward the influent fluid flowing to said moisture separator.

2. The moisture separator of claim 1, wherein:

said upset end is a deformation of the wall of said tubular nipples in a direction which is generally perpendicular to a central axis of said tubular nipples.

3. The moisture separator of claim 1, wherein:

said upset end is a deformation of the wall of said tubular nipples in a direction which is between 10 and 80 degrees from a central axis of said tubular nipples.

4. The moisture separator of claim 1, wherein:

said holes in said first plate are shaped to receive said upset end of said tubular nipples.

5. The moisture separator of claim 1, wherein:

said first and second plates are made of steel.

* * * * *